US009305501B2

(12) United States Patent
Choi et al.

(10) Patent No.: US 9,305,501 B2
(45) Date of Patent: Apr. 5, 2016

(54) DISPLAY DEVICE AND DRIVING METHOD THEREOF

(71) Applicant: Samsung Display Co., Ltd., Yongin (KR)

(72) Inventors: Yong-Jun Choi, Asan-si (KR); Hyun Seok Ko, Yongin-si (KR); Po-Yun Park, Seoul (KR); Min Joo Lee, Seoul (KR); Jung-Hwan Cho, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 418 days.

(21) Appl. No.: 13/668,777

(22) Filed: Nov. 5, 2012

(65) Prior Publication Data

US 2014/0015820 A1 Jan. 16, 2014

(30) Foreign Application Priority Data

Jul. 12, 2012 (KR) ..... 10-2012-0075996

(51) Int. Cl.
*G09G 5/00* (2006.01)
*G09G 3/36* (2006.01)

(52) U.S. Cl.
CPC ..... *G09G 3/3614* (2013.01); *G09G 2320/0247* (2013.01); *G09G 2330/021* (2013.01); *G09G 2360/10* (2013.01)

(58) Field of Classification Search
CPC . G09G 5/00; G09G 2320/103; G09G 3/3618; G09G 3/3614
USPC ..... 345/209, 96, 79, 54
See application file for complete search history.

(56) References Cited

U.S. PATENT DOCUMENTS

| | | | | |
|---|---|---|---|---|
| 4,651,211 | A * | 3/1987 | Weckenbrock et al. | 348/702 |
| 6,603,454 | B1 * | 8/2003 | Nakamura | G09G 3/3633 345/100 |
| 8,115,722 | B2 | 2/2012 | Kim | |
| 8,354,977 | B2 * | 1/2013 | Chen | G09G 3/3692 345/210 |
| 2003/0020699 | A1 * | 1/2003 | Nakatani et al. | 345/204 |
| 2003/0122773 | A1 * | 7/2003 | Washio | G09G 3/3648 345/103 |
| 2004/0051706 | A1 * | 3/2004 | Nakano et al. | 345/204 |
| 2004/0113879 | A1 * | 6/2004 | Sekiguchi et al. | 345/94 |
| 2007/0126723 | A1 * | 6/2007 | Hong | G09G 3/3648 345/204 |
| 2007/0279328 | A1 * | 12/2007 | Takada | G09G 3/293 345/63 |
| 2009/0040151 | A1 | 2/2009 | Lee | |
| 2009/0184909 | A1 * | 7/2009 | Takeda | 345/87 |
| 2009/0251445 | A1 * | 10/2009 | Ito et al. | 345/204 |
| 2009/0273555 | A1 * | 11/2009 | Song | G09G 3/3666 345/96 |

(Continued)

FOREIGN PATENT DOCUMENTS

| | | |
|---|---|---|
| JP | 2004-354900 | 12/2004 |
| JP | 2008-209828 | 9/2008 |

(Continued)

*Primary Examiner* — Seokyun Moon
*Assistant Examiner* — Josemarie G Acha, III
(74) *Attorney, Agent, or Firm* — H.C. Park & Associates, PLC

(57) ABSTRACT

A method to drive a display device includes: transmitting at least one data voltage to one or more of a plurality of data lines, scanning one or more of a plurality of gate lines to enable transmission of a gate signal in association with a first frame of a first hold section of a first still image section associated with display of a still image, and scanning one or more of the plurality of gate lines to enable transmission of the gate signal every frame of a first refresh section. The first still image section comprises the first refresh section.

10 Claims, 12 Drawing Sheets

(56) References Cited

U.S. PATENT DOCUMENTS

| | | | | |
|---|---|---|---|---|
| 2010/0207953 | A1* | 8/2010 | Kim | G09G 3/36 345/555 |
| 2011/0193891 | A1* | 8/2011 | Lee | G09G 3/003 345/690 |
| 2011/0221726 | A1 | 9/2011 | Huitema | |
| 2011/0267381 | A1* | 11/2011 | Yamazaki et al. | 345/690 |
| 2011/0279419 | A1 | 11/2011 | Takemura | |
| 2012/0200549 | A1* | 8/2012 | Sasaki et al. | 345/209 |
| 2013/0038621 | A1 | 2/2013 | Choi et al. | |

FOREIGN PATENT DOCUMENTS

| | | |
|---|---|---|
| JP | 2011-150307 | 8/2011 |
| KR | 10-2005-0055252 | 6/2005 |
| KR | 10-2005-0060033 | 6/2005 |
| KR | 10-0702052 | 3/2007 |
| KR | 10-2008-0046980 | 5/2008 |
| KR | 10-0965591 | 6/2010 |
| KR | 10-2011-0078711 | 7/2011 |
| KR | 10-2013-0018493 | 2/2013 |

* cited by examiner

FIG. 12

| Driving frequency | flicker (dB) |
|---|---|
| Motion picture frequency : 60Hz | -56.4 |
| Motion picture frequency : 30Hz | -41.9 |
| Motion picture frequency : 20Hz | -39.2 |
| Still image frequency : 20~30Hz | -51.8 |
| Still image frequency : 15~20Hz | -50.8 |

DISPLAY DEVICE AND DRIVING METHOD THEREOF

CROSS-REFERENCE TO RELATED APPLICATION

This application claims priority from and the benefit of Korean Patent Application No. 10-2012-0075996, filed on Jul. 12, 2012, which is incorporated by reference for all purposes as if set forth herein.

BACKGROUND

1. Field

Exemplary embodiments of the present disclosure relate to display technology, and more particularly to a display device and a method of driving the same.

2. Discussion

Displays are typically utilized in association with various modern electronic devices, such as computers, televisions, mobile phones, personal digital assistants, etc. Conventional display device include cathode ray tubes, liquid crystal displays, plasma displays, and the like.

In general, display devices typically include a graphic processing unit (GPU), a display panel configured to display an image, and a signal controller.

The GPU is usually configured to transmit, to the signal controller, an input image signal to facilitate display of an image via the display panel. The signal controller is generally configured to generate at least one control signal to drive the display panel and transmit the at least one control signal together with the image signal to the display panel.

The image displayed via the display panel may be divided into a still image and a motion picture. In this manner, conventional display panels are configured to display images on the basis of a frame rate, e.g., several frames per minute, and therefore, conventional display panels will be driven to display still images when image signals of neighboring frames are the same, and display motion pictures when image signals of neighboring frames are different. As such, the signal controller is typically configured to receive, from the GPU, an input image signal associated with every frame to be displayed via the display panel. Accordingly, when a still image is to be displayed, conventional signal controllers repeatedly receive the same input image signal in association with each frame in which the still image is to be displayed, such that excessive power consumption occurs.

The above information disclosed in this Background section is only for enhancement of understanding of the background of the invention and, therefore, it may contain information that does not form any part of the prior art nor what the prior art may suggest to a person of ordinary skill in the art.

SUMMARY

Exemplary embodiments provide a display device that is configured to reduce power consumption and display defects.

Exemplary embodiments provide a method to drive a display device to facilitate reduction in power consumption and display defects.

Additional aspects will be set forth in the detailed description which follows and, in part, will be apparent from the disclosure, or may be learned by practice of the invention.

According to exemplary embodiments, a method to drive a display device includes: transmitting at least one data voltage to one or more of a plurality of data lines; scanning one or more of a plurality of gate lines to enable transmission of a gate signal in association with a first frame of a first hold section of a first still image section associated with display of a still image; and scanning one or more of the plurality of gate lines to enable transmission of the gate signal every frame of a first refresh section, wherein the first still image section includes the first refresh section.

According to exemplary embodiments, a display device includes: a plurality of gate lines configured to transmit a gate signal; a plurality of data lines configured to transmit a data voltage; a plurality of pixels connected to the plurality of gate lines and the plurality of data lines; a gate driver configured to transmit the gate signal to at least some of the plurality of gate lines; a data driver configured to transmit the data voltage to at least some of the plurality of data lines; and a signal controller configured to control the gate driver and the data driver, wherein the plurality of pixels are configured to display a still image in association with a still image section including a first hold section and a first refresh section, and wherein the gate driver is further configured to: scan at least some of the plurality of gate lines to enable transmission of the gate signal to at least some of the plurality of pixels in association with a first frame of the first hold section, and scan at least some of the plurality of gate lines to enable transmission of the gate signal every frame of the first refresh section.

According to exemplary embodiments, a method includes: causing, at least in part, a motion picture section to be displayed based on reception of an image signal transmission, the image signal transmission being associated with display of a still image between motion picture sections; receiving an indication corresponding to a transition between display of the motion picture section and display of a still image section; causing, at least in part, the image signal transmission to be halted in response to receiving the indication; and causing, at least in part, the still image to be displayed in association with the still image section.

According to exemplary embodiments, display quality may be improved while reducing power consumption.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

FIG. 12 is a table of measured flicker levels associated with a display device, according to exemplary embodiments.

DETAILED DESCRIPTION

Figure 1:
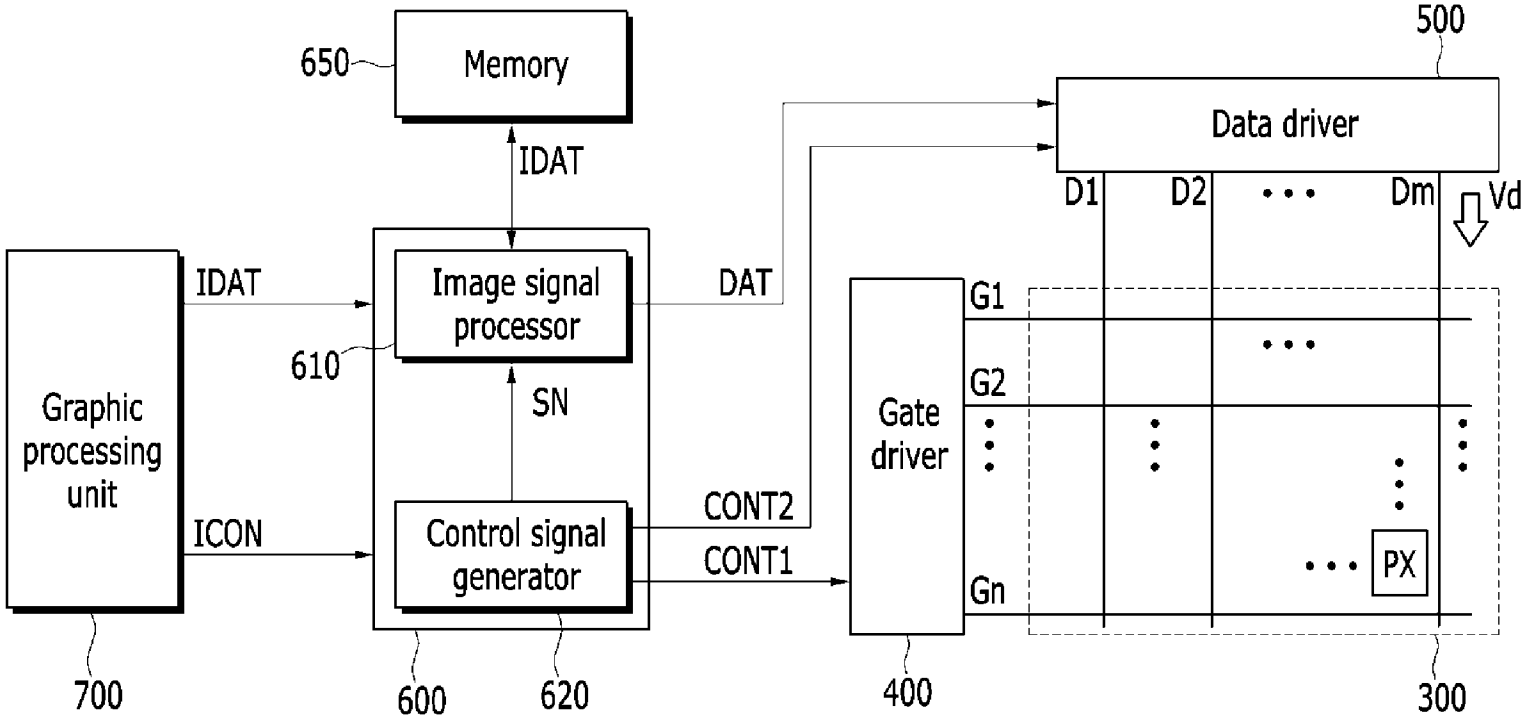
FIG. 1 is a block diagram of a display device, according to exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers and/or regions may be exaggerated for clarity and descriptive purposes. Also, like reference numerals denote like elements.

When an element or layer is referred to as being "on," "connected to," or "coupled to" another element or layer, it may be directly on, directly connected to, or directly coupled to the other element or layer, or intervening elements or layers may be present. When, however, an element is referred to as being "directly on," "directly connected to," or "directly coupled to" another element or layer, there are no intervening elements or layers present. For the purposes of this disclosure, "at least one of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, third, etc., may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section that is discussed below may be termed a second element, component, region, layer, or section without departing from the teachings of the present invention.

Spatially relative terms, such as "beneath," "below," "lower," "above," "upper," and/or the like, may be used herein for descriptive purposes and, thereby, to describe one element or feature's relationship to another element(s) or feature(s) as illustrated in the drawings. Spatially relative terms are intended to encompass different orientations of an apparatus in use or operation in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations) and, as such, the spatially relative descriptors used herein are to be interpreted accordingly.

The terminology used herein is for the purpose of describing particular embodiments only and is not intended to be limiting. As used herein, the singular forms "a," "an," and "the" are intended to include the plural forms as well, unless the context clearly indicates otherwise. Moreover, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Figure 2:
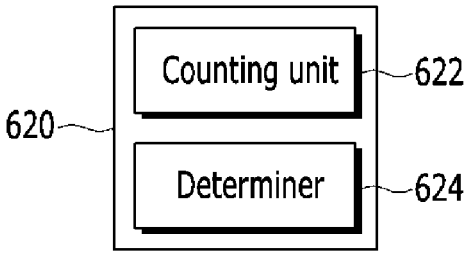
FIG. 2 is a block diagram of a control signal generator, according to exemplary embodiments.

FIG. 1 is a block diagram of a display device, according to exemplary embodiments. FIG. 2 is a block diagram of a control signal generator, according to exemplary embodiments.

As seen in FIG. 1, the display device includes a display panel 300, a gate driver 400, a data driver 500, a signal controller 600 to control the data driver 500 and the gate driver 400, a memory 650, and a graphic processing unit (GPU) 700. While specific reference will be made to this particular implementation, it is also contemplated that the display apparatus may embody many forms and include multiple and/or alternative components or features. For example, it is contemplated that the components of the display apparatus may be combined, located in separate structures, and/or separate locations.

According to exemplary embodiments, the display panel 300 may be a display panel associated with or implementing a flat panel display (FPD), such as, for example, one or more self-emissive or non-self-emissive display technologies, e.g., a liquid crystal display (LCD), an organic light emitting display (OLED), a plasma display (PD), an electrowetting display (EWD), an electrophoretic display (EPD), and/or the like.

In one implementation, the display panel 300 includes a plurality of gate lines G1 to Gn, a plurality of data lines D1 to Dm, and a plurality of pixels PX connected to the plurality of gate lines G1 to Gn and the plurality of data lines D1 to Dm. It is contemplated, however, that display panel 300 may be alternatively and/or additionally configured, such as to include one or more additional and/or alternative components.

The gate lines G1 to Gn are configured to transmit at least one gate signal, and may be extended substantially in a row direction. For instance, gate lines G1 to Gn may be extended parallel (or substantially parallel) to one another. The data lines D1 to Dm are configured to transmit at least one data voltage Vd, and may be extend substantially in a column direction. For example, the data lines D1 to Dm may be extended parallel (or substantially parallel) to one another.

The plurality of pixels PX may be substantially arranged in a matrix form; however, any other suitable arrangement may be utilized. Each pixel PX may include a switching element (not shown) connected to a corresponding gate line G1 to Gn and a corresponding data line D1 to Dm, and a pixel electrode (not shown) connected to the switching element (or device). The switching element may be turned on or turned off in response to a gate signal received via the gate line G1 to Gn to selectively transmit the data voltage Vd from the data line D1 to Dm to the pixel electrode. Each pixel PX is configured to display an image of corresponding luminance according to the data voltage Vd applied to the pixel electrode.

The gate driver 400 is configured to receive at least one gate control signal CONT1 from the signal controller 600, and to generate at least one gate signal including a combination of a gate-on voltage Von (utilized to turn on the switching element of corresponding pixels PX) and a gate-off voltage Voff (utilized to turn off the switching element of corresponding pixels PX) based on the received at least one gate control signal CONT 1. For ease of description, the at least one gate control signal CONT 1 will be collectively referred to, hereinafter, as gate control signal CONT1. The gate control signal CONT1 includes a scanning start signal STV to indicate a scanning start, a gate clock signal CPV to control an output time of the gate-on voltage Von, at least one low voltage, and/or the like. Further, the gate driver 400 is connected to the gate lines G1 to Gn of the display panel 300 and, thereby, configured to apply the gate signal(s) to the gate lines G1 to Gn.

The data driver 500 is configured to receive at least one data control signal CONT2 and image data DAT from, for example, the signal controller 600, and to generate the image data DAT as the data voltage(s) Vd, which is an analog data signal, based on selection of a grayscale voltage corresponding to each image data DAT. For ease of description, the at least one data control signal CONT2 will be collectively referred to, hereinafter, as data control signal CONT2. The data control signal CONT2 includes a horizontal synchronization start signal STH to indicate a transmission start of the image data DAT for pixels PX in one row and a load signal to apply a corresponding data voltage Vd to respective data lines D1 to Dm. The data control signal CONT2 may also include a reverse signal to reverse a polarity of the data voltage Vd (also referred to as a polarity of the data voltage) for a common voltage Vcom. To this end, the data driver 500 is connected to the data lines D1 to Dm of the display panel 300 and, thereby, configured to apply the data voltage(s) Vd to the corresponding data lines D1 to Dm.

The signal controller 600 is configured to receive, from the GPU 700, an input image signal IDAT and an input control signal ICON, which is configured to facilitate display control of the input image signal IDAT. The input image signal IDAT includes information associated with luminance of individual pixels PX. It is noted that the luminance may be a predetermined number associated with a grayscale. An exemplary input control signal ICON may include, for instance, a vertical synchronization signal VSync, a horizontal synchronizing signal HSync, a main clock signal, a data enable signal, and/or the like. According to exemplary embodiments, the input control signal ICON may also include a still image start signal to indicate a start of a still image and a still image stop signal to indicate informing a stop of the still image. To this end, a still image may be associated with images of neighboring frames being the same, and a motion picture may be associated with images of neighboring frames being different. Further, a still image section may correspond to a section configured to display the still image and a motion picture section may relate to a section configured to display the motion picture.

With continued reference to FIG. 1, the signal controller 600 may embody computing hardware, as well as include one or more include one or more components configured to execute (or provide) the processes/features described herein. To this end, the signal controller 600 may be implemented via software, hardware, firmware, or a combination thereof. For instance, signal controller 600 may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like. In one implementation signal controller 600 includes an image signal processor 610 and a control signal generator 620. While specific reference will be made to this particular implementation, it is also contemplated that signal controller 600 may embody many forms and include multiple and/or alternative components. For example, it is contemplated that the components of signal controller 600 may be combined, located in separate structures, or separate locations.

According to exemplary embodiments, the image signal processor 610 processes the input image signal IDAT based on the input image signal IDAT and the input control signal ICON to convert the input image signal IDAT to the image data DAT.

In exemplary embodiments, when the still image start signal is received from the GPU 700, the still image section is started, and the image signal processor 610 is configured to store the input image signal IDAT of a frame at which the still image is started in, for instance, memory 650. The image signal processor 610 is configured to process the input image signal IDAT stored in the memory 650 and transmit the processed input image signal IDAT to the display panel 300 in response to initialization of (and/or during) the still image section. The memory 650 may be a frame memory. To this end, memory 650 may include volatile and/or non-volatile memory, such as erasable programmable read-only memory (EPROM), electrically erasable programmable read-only memory (EEPROM), flash memory, random access memory (RAM), read only memory (ROM), etc., as well as include any other suitable dynamic and/or static storage devices. Further, memory 650 may be implemented as one or more discrete devices, stacked devices, and/or integrated with signal controller 600. The signal controller 600 may also be configured to inactivate the GPU 700 so that the GPU 700 halts transmission of the input image signal IDAT until, for example, display of the still image is finished. For instance, signal controller 600 may be configured to inactivate GPU 700 for a time period corresponding to predetermined number of frames associated with the display of the still image. It is noted, however, that the inherent processing capabilities of the various components described herein, it may be that signal controller 600 reactivates GPU 700 before display of the still image is completely finished. It is also noted that the image signal processor 610 may not utilize the memory 650 in association with the display of a motion picture section.

The image signal processor 610 may also be configured to process the input image signal IDAT based on a data modification signal SN received from, for instance, the control signal generator 620. The processing of the input image signal IDAT is described in more detail below.

The control signal generator 620 is configured to generate the gate control signal CONT1, the data control signal CONT2, and the like, based on the input image signal IDAT and the input control signal ICON.

Adverting to FIG. 2, the control signal generator 620 may include a counting unit 622 and a determiner 624. While specific reference will be made to this particular implementation, it is also contemplated that control signal generator 620 may embody many forms and include multiple and/or alternative components.

According to exemplary embodiments, when the still image start signal is received, the counting unit 622 may be configured to count the number of some or all of the frames based on the input image signal IDAT. Counting unit 622 may be further configured to sum polarities associated with the data voltage Vd in the still image section. For instance, a positive polarity (despite the actual data voltage value) may be defined as "+1," e.g., if Vd is +12 V then the positive polarity may be recorded as +1. Similarly, a negative polarity (despite the actual data voltage value) may be defined as "−1"

e.g., if Vd is −12 V then the negative polarity may be recorded as −1. In this manner, the aggregation of positive and negative polarities produces a sum total. That is, if there were three (3) positive polarities and four (4) negative polarities, then the sum total would be negative one (−1) and, thereby, represent a negative polarity.

The determiner 624 is configured to determine polarities and the number of frames included in a next still image section based on the number of counted frames and a result of the sum of the polarities determined via the counting unit 622 in the still image section. In this manner, determiner 624 is configured to generate the data modification signal SN.

The control signal generator 620 is configured to generate the gate control signal CONT1 and the data control signal CONT2 based on the data modification signal SN received from, for instance, the determiner 624. In this manner, the control signal generator 620 is configured to transmit the data modification signal SN to the image signal processor 610.

Adverting back to FIG. 1, the GPU 700 is configured to transmit the input image signal IDAT and the input control signal ICON to the signal controller 600.

According to exemplary embodiments, the GPU 700 can transmit the input image signal IDAT in association with one or more frames, e.g., every frame, to the signal controller 600 during a motion picture section, and may be inactivated (e.g., prevented from transmitting the input image signal IDAT to the signal controller 600) during the still image section. In this manner, the signal controller 600 is configured to process the input image signal IDAT of the still image stored in the memory 650 and to transmit the processed input image signal IDAT to the display panel 300.

The GPU 700 is configured to transmit the still image start signal to the signal controller 600 at a switching point, i.e., a point at which the input image signal IDAT of the still image section is transmitted to initiate display of the still image while the input image signal IDAT of the motion picture section is also being transmitted to the signal controller 600. The GPU 700 is also configured to transmit the input image signal of one or more frames, e.g., every frame, to the signal controller 600 by transmitting the still image stop signal to the signal controller 600 at a switching point where the motion picture section starts.

A method to drive a display device according to various exemplary embodiments is described in more detail in association with FIGS. 3-8, along with continued reference to FIGS. 1 and 2 described above.

Figure 3:
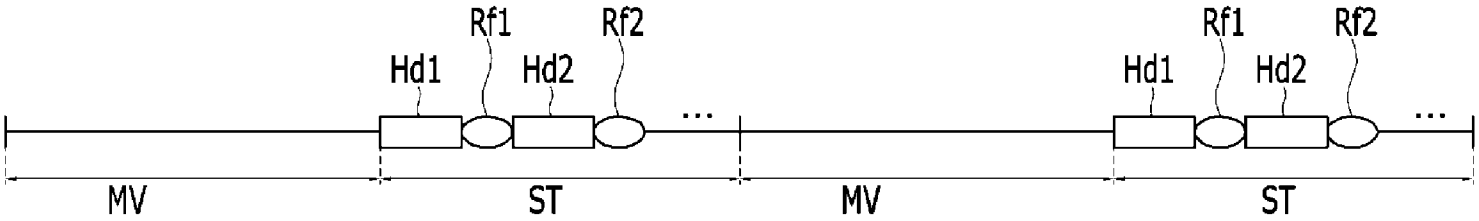
FIG. 3 is a timing diagram associated with image display, according to exemplary embodiments.

FIG. 3 is a timing diagram associated with image display, according to exemplary embodiments. FIGS. 4-7 are waveform diagrams associated with a driving signal of a display device, according to exemplary embodiments. FIG. 8 is a timing diagram associated with image display, according to exemplary embodiments.

With reference to FIG. 3, when an image to be displayed via display panel 300 includes a motion picture and a still image, a motion picture section MV corresponding to a section associated with display of the motion picture and a still image section ST corresponding to a section associated with display of the still image can be, for instance, alternately disposed, e.g., temporally.

According to exemplary embodiments, the GPU 700 is configured to transmit the input image signal IDAT of the motion picture section MV and the input control signal ICON to the signal controller 600 in the motion picture section MV.

The signal controller 600 is configured to generate the image data DAT, the gate control signal CONT1, and the data control signal CONT2 based on the input image signal IDAT and the input control signal ICON. To this end, the signal controller 600 may export (e.g., transmit) the gate control signal CONT1 to the gate driver 400, as well as export (e.g., transmit) the image data DAT and the data control signal CONT2 to the data driver 500.

The data driver 500 is configured to convert image data DAT to corresponding data voltages Vd based on the data control signal CONT2. Further, the data driver 500 is configured to apply the data voltage(s) Vd to the corresponding data lines D1 to Dm.

The gate driver 400 is configured to sequentially apply the gate on voltage Von to all the gate lines G1 to Gn based on the gate control signal CONT1 to turn on the switching elements connected to the gate lines G1 to Gn. This is referred to as a gate scanning GS for one frame. The data voltage Vd is then applied to the data lines D1 to Dm and applied to the corresponding pixel PX via the turned on switching element.

As described above, an image of one frame is displayed by executing the above-noted gate scanning GS for all the gate lines G1 to Gn so as to apply the data voltage(s) Vd to all the pixels PX. The polarity of the data voltage(s) Vd may be changed in every frame, and polarities of data voltages Vd of neighboring data lines D1 to Dm may be different according to a characteristic of the reverse signal RVS, even within one frame.

The display panel 300 is configured to display the motion picture with a first frequency in the motion picture section. For example, the first frequency may be 60 Hz, 120 Hz, and the like.

When the still image section ST starts, the GPU 700 is configured to transmit the input image signal IDAT of the still image and the input control signal ICON along with the still image start signal to indicate the start of the still image section to the signal controller 600. The signal controller 600 is configured to receive the still image start signal, recognize the start of the still image section, and store the input image signal IDAT of the still image section in memory 650. Further, the signal controller 600 is configured to inactivate the GPU 700 so that the GPU 700 does not transmit the input image signal IDAT of the still image section any more. It is noted, however, that GPU 700 may still continue to analyze (or otherwise process) the input image signal IDAT so as to determine the stop of the still image and, if necessary, the start of another still image or motion picture section.

The signal controller 600 is configured to process the input image signal IDAT of the still image section stored in the memory 650 to generate the image data DAT, and to transmit the generated image data DAT to the data driver 500. The display panel 300 is configured to display an image of one frame via application of the data voltage(s) Vd to all the pixels PX, which may be similar to as in the motion picture section MV as described above.

In response to a next motion picture section start, the GPU 700 can transmit the input image signal IDAT of the motion picture section and the input control signal ICON along with the still image stop signal to indicate the stop of the still image to the signal controller 600.

According to exemplary embodiments, the still image may be displayed based on a second frequency, which may be lower than the above-noted first frequency associated with display of the motion picture section MV, in the still image section ST. It is noted, however, that the second frequency may be reduced, which has an added benefit of enabling a flicker to become, for all practical purposes, not readily visible. As described above, the still image is displayed with a lower frequency in comparison with the motion picture, and accordingly power consumption can be reduced. Further, when the still image is displayed, the GPU is inactivated, so that the power consumption can be further reduced. Moreover, because the frequency is lowered, flicker effects may also be reduced, if not eliminated.

According to exemplary embodiments, the still image section ST includes at least one of hold sections Hd1, Hd2, . . . , Hdp (where p is a natural number). When the still image section ST includes two or more hold sections Hd1 to Hdp, the still image section ST further includes at least one of refresh sections Rf1, Rf2, . . . , Rfk (where k is a natural number). The refresh sections Rf1 to Rfk are sequentially located between two neighboring hold sections Hd1 to Hdp. The number of hold sections Hd1 to Hdp and refresh sections Rf1 to Rfk included in one still image section ST, information on whether the last section of the still image section ST is the hold section Hd1 to Hdp or the refresh section Rf1 to Rfk, the number of frames included in the last section Hd1 to Hdp or Rf1 to Rfk, and/or the like, may be different according to the number of total frames of the still image section ST.

With reference to FIGS. 4-7, one of the hold sections Hd1 to Hdp may include one or more frames, and one of the refresh sections Rf1 to Rfk may also include one or more frames. Numbers N and N' of frames included in the hold sections Hd1 to Hdp may be the same as or different from each other (where N and N' are natural numbers). Similarly, numbers M and M' of frames included in the refresh sections Rf1 to Rfk may be the same as or different from each other (where M and M' are natural numbers).

The first hold section Hd1 of N frames may start simultaneously with a start of one still image section ST. When the first hold section Hd1 starts, one gate scanning GS process is performed during a first frame. As such, the data voltage Vd is charged to the pixels PX, but the gate scanning is not performed during the remaining time. Accordingly, another charging of the data voltage Vd is not performed during N−1 frames after the gate scanning GS ends, and the voltage charged to the pixel PX may be discharged due to a leakage according to a time. Luminance of the pixels PX at a time when the first hold section Hd1 ends may be lower than target luminance of the still image. According to exemplary embodiments, the luminance of the pixels PX may become higher than the target luminance due to the discharging at the time when the first hold section Hd1 ends.

When an absolute value of the data voltage Vd corresponding to the target luminance of the still image corresponds to a target voltage Vt, the data voltage Vd charged in the first hold section Hd1 may be the target voltage Vt. In exemplary embodiments, the data voltage Vd charged to the pixel PX in the first frame of the first hold section Hd1 may be a negative target voltage −Vt. As seen in FIGS. 4-7, a polarity of the data voltage Vd charged in the first hold section Hd1 is illustrated as a negative polarity as an example, but may be a positive polarity.

According to exemplary embodiments, the polarity of the data voltage Vd in the first hold section Hd1 of the still image section ST may be changed according to the number of frames counted in association with a previous still image section ST and a result of the sum of the polarities determined via the counting unit 622. When the polarity summed in the previous still image section ST is the positive polarity (+), the polarity of the data voltage Vd in the first hold section Hd1 of the still image section ST may be the negative polarity (−). In contrast, when the polarity summed in the previous still image section ST is the negative polarity (−), the polarity of the data voltage Vd in the first hold section Hd1 of the still image section ST may be the positive polarity (+).

When the first hold section Hd1 ends, the first refresh section Rf1 of M frames starts. In the first refresh section Rf1, the gate scanning GS is performed in every frame. Accordingly, the data voltage Vd is charged in all pixels PX in every frame. Further, the polarity of the data voltage Vd may be reversed in every frame.

An absolute value of the data voltage Vd applied to the data lines D1 to Dm in the first refresh section Rf1 may be different according to a discharge amount in the first hold section Hd1. Specifically, as described above, when the counting unit 622 counts the number of frames in the first hold section Hd1 and sums the polarities, the determiner 624 is configured to generate the data modification signal SN based on the counting and the polarity result. The data modification signal SN may contain information on the absolute value of the data voltage Vd in the first refresh section Rf1 and polarity information. The image signal processor 610 is configured to process the received image signal IDAT based on the data modification signal SN to generate the image data DAT.

Alternatively, the control signal generator 620 may be configured to directly generate the image data DAT by correcting the input image signal IDAT based on a result of the determination of the determiner 624 after reception of the input image signal IDAT from the image signal processor 610. In this manner, the control signal generator 620 may be configured to transmit the generated image data DAT to the data driver 500 along with the data control signal CONT2.

Further, the control signal generator 620 may be configured to determine the polarity of the data voltage Vd of the first frame in the next still image section ST based on the data modification signal SN in the previous still image section ST or determine the number of frames in the hold sections Hd1 to Hdp of the next still image section ST, and generate the control signals CONT1 and CONT2 based on the determination.

With continued reference to FIGS. 4-7, when absolute values of the data voltage Vd received at the display panel 300 in every frame of the first refresh section Rf1 are a first voltage V1, a second voltage V2, a third voltage V3, . . . , and an $r^{th}$ voltage Vr (where r is a natural number) in a frame progress order, the first voltage V1 may be smaller than or equal to the target voltage Vt. Further, absolute values of the first voltage V1, the second voltage V2, the third voltage V3, . . . , and the $r^{th}$ voltage Vr may be larger in the above listed order or the same as each other, and the last $r^{th}$ voltage Vr may be close to the target voltage Vt or have substantially the same value.

According to exemplary embodiments, it is possible to make a difference between the luminance in the last frame of the first hold section Hd1 and the luminance in the first frame of the first refresh section Rf1 invisible, as well as possible to prevent the flicker by controlling the absolute value V1 of the data voltage Vd charged in the first frame of the first refresh section Rf1 in consideration of a discharged voltage of the pixel PX in the first hold section Hd1.

According to exemplary embodiments, the image signal processor 610 may be configured to display an image exhibiting luminance between grayscales associated with the image data DAT by temporally or spatially mixing images of two or more grayscales. In such a display apparatus, the absolute value of the data voltage Vd charged to the data lines D1 to Dm in the first refresh section Rf1 can be more minutely controlled. Accordingly, it is possible to effectively prevent a change in the luminance from being visible in the still image section ST.

According to exemplary embodiments, the absolute value of the data voltage Vd charged in the first refresh section Rf1 may be controlled to have a larger value than the target voltage Vt according to a type of the display panel 300 and the change in the luminance of the pixel PX according to a time in the first hold section Hd1.

The number M of frames in the first refresh section Rf1 may be changed according to a length of a current still image section ST, and the like, as a result of the counting of the frames via the counting unit 622 or may be preset as the predetermined number according to a design factor of the display panel 300.

Figure 4:
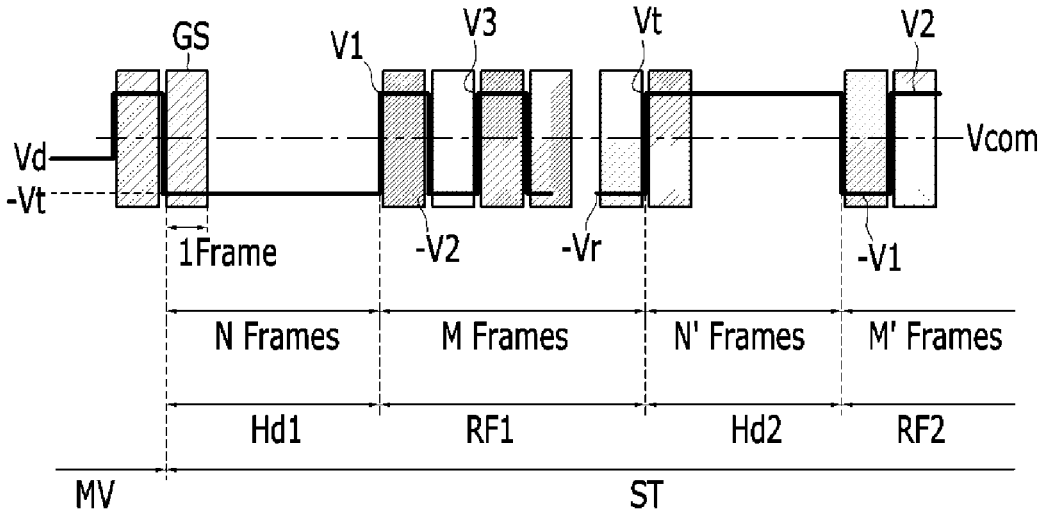
FIGS. 4-7 are waveform diagrams associated with a driving signal of a display device, according to exemplary embodiments.
Figure 5:
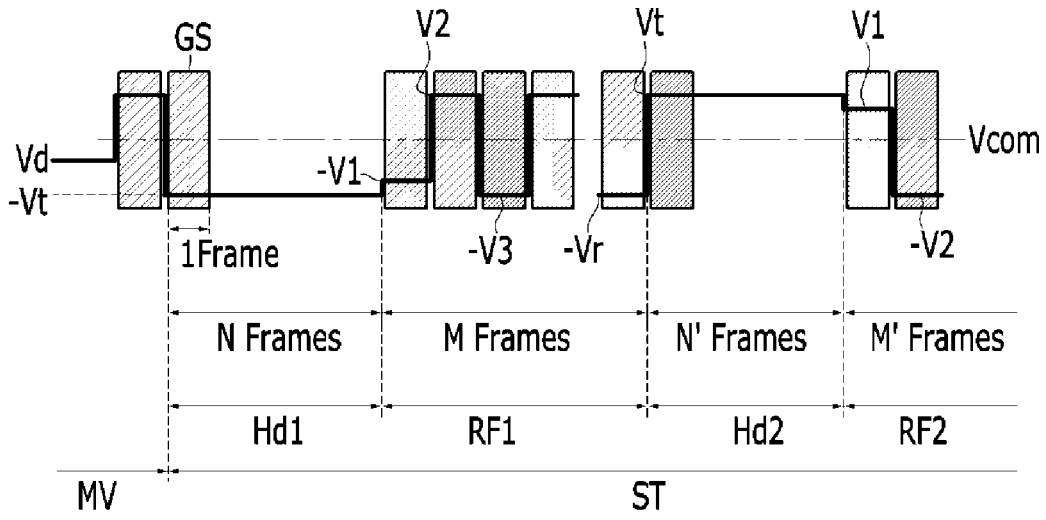
Figure 6:
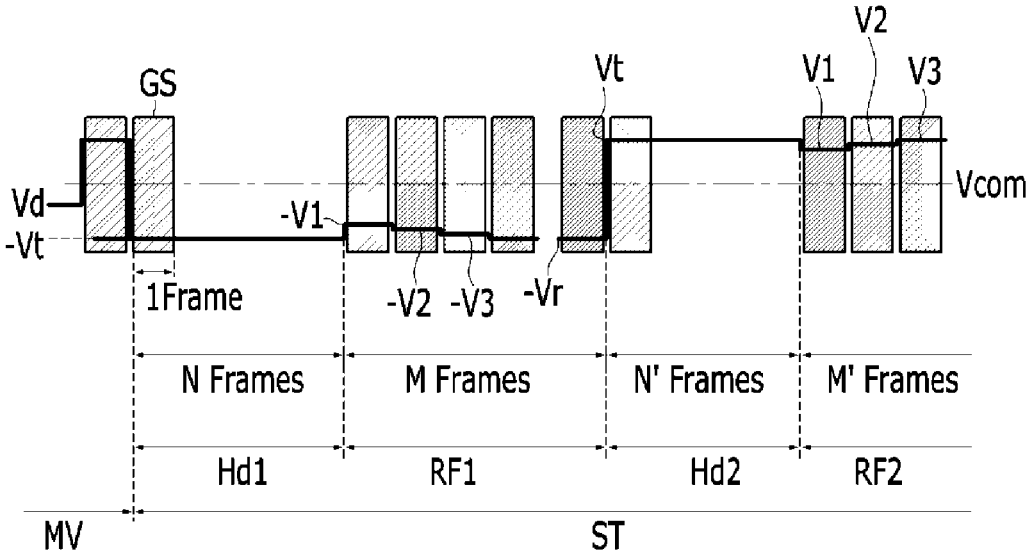
Figure 7:
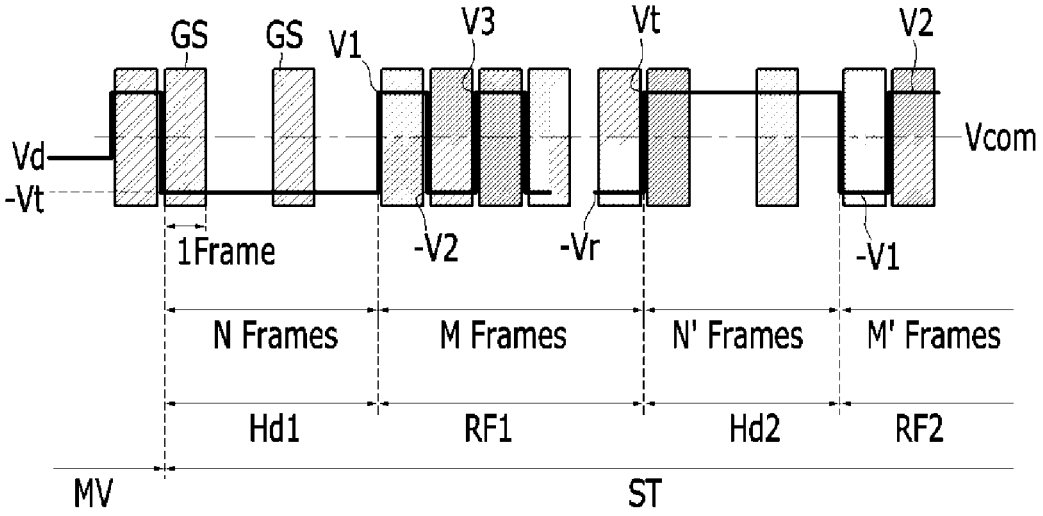
Figure 8:
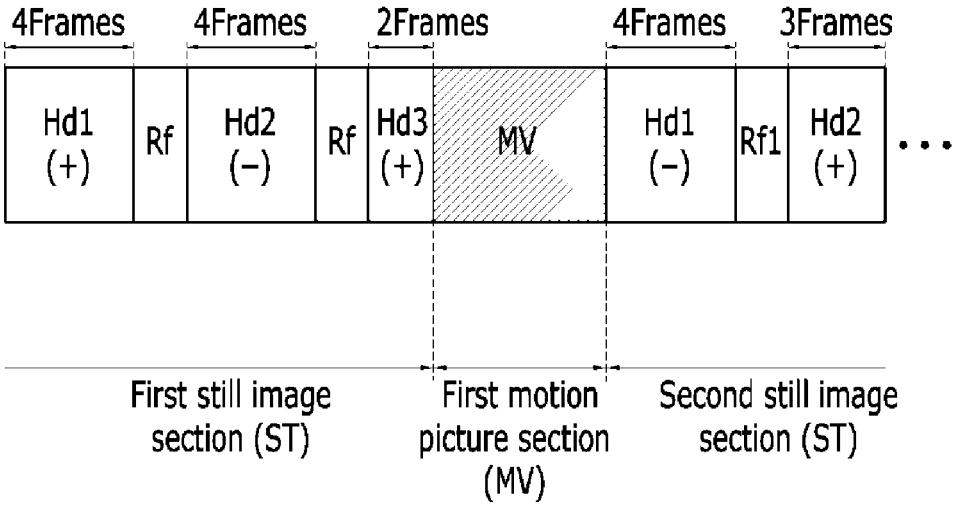
FIG. 8 is a timing diagram associated with image display, according to exemplary embodiments.

FIGS. 4 and 7 demonstrate the polarity of the data voltage Vd charged to the first frame of the first refresh section Rf1 being opposite to the polarity of the data voltage Vd in the first hold section Hd1, whereas FIGS. 5 and 6 demonstrate the polarity of the data voltage Vd charged to the first frame of the first refresh section Rf1 being the same as the polarity of the data voltage Vd in the first hold section Hd1.

As seen in FIGS. 4 and 5, the polarity of the data voltage Vd may be reversed in every frame during the first refresh section Rf1. However, dissimilarly to FIGS. 4 and 5, the polarity of the data voltage Vd may be constant during the first refresh section Rf1, such as shown in FIGS. 6 and 7.

When the first refresh section Rf1 ends, the second hold section Hd2 starts. An operation of the second hold section Hd2 is mostly the same as an operation of the first hold section Hd1. However, the polarity of the data voltage Vd in the second hold section Hd2 may be opposite to the polarity of the data voltage Vd in the first hold section Hd1. Accordingly, in a case of the display device being driven via a frame inversion, the polarity of the data voltage Vd in the last frame of the first refresh section Rf1 right before the second hold section Hd2 starts is opposite to the polarity of the data voltage Vd in the second hold section Hd2.

When the data voltage Vd exhibiting the same polarity is continuously charged to the pixel PX, an after image created by accumulation of electric charges of one polarity may be generated. An after image can be prevented if the polarity of the data voltage Vd in the second hold section Hd2 is opposite to the polarity of the data voltage Vd in the first hold section Hd1 before the start of the second hold section Hd2.

The number N' of frames in the second hold section Hd2 may be the same as or different from the number N of frames in the first hold section Hd1.

Specifically, the counting unit 622 may be configured to sum the polarities of the data voltage Vd in at least one previous still image section ST before the present (or current) still image section ST, count the number of frames, and determine the number of frames in each of the hold sections Hd1 to Hdp of the current still image section ST.

For example, and with reference to FIG. 8, it is assumed that a first still image section ST corresponding to the previous still image section ST includes two hold sections Hd1 and Hd2 having four frames and one hold section Hd3 having two frames, and includes two refresh sections Rf. In this manner, the last hold section Hd3 exhibits a number of frames smaller than the numbers of frames in the other hold sections Hd1 and Hd2 according to a length of the first still image section ST. The counting unit 622 can sum polarities of the first still image section ST, and determine the summed polarities as two positive polarities. Then, the determiner 624 can determine that the polarity of the data voltage Vd in the first hold section Hd1 of the second still image section ST corresponding to the current still image section ST should be the negative polarity after the first motion picture section MV ends, the first motion picture section starting after the first still image section ST ends.

Further, in order to rapidly resolve positive polarities accumulated in the first still image section ST, the number of frames in the second hold section Hd2 of the second still image section ST may be controlled to have a value smaller than the number of frames in the first hold section Hd1. Since the polarity of the data voltage Vd in the second hold section Hd2 is opposite to that in the first hold section Hd1, the summed polarities may be one positive polarity when the second hold section Hd2 passes.

Adverting back to FIGS. 4-7, when the second hold section Hd2 ends, the second refresh section Rf2 starts and its operation is mostly the same as the operation of the first refresh section Rf1. However, the number M' of frames in the second refresh section Rf2 may be the same as or different from the number M of frames in the first refresh section Rf1.

The above described operation may be repeated in the remaining sections of the still image section ST.

According to exemplary embodiments, one or more gate scanning GS processes can be summed between the hold sections Hd1 to Hdp as shown in FIG. 7. In this manner, a frequency of the gate scanning GS in the hold sections Hd1 to Hdp may be smaller than a frequency of the gate scanning GS in the motion picture section MV. A position of the added gate scanning GS performed in an intermediate frame of the hold section Hd1 to Hdp may be constant or changed in every hold section Hd1 to Hdp. Accordingly, it is possible to further reduce luminance deterioration in the hold sections Hd1 to Hdp.

According to exemplary embodiments, when the target voltage Vt of the still image is charged directly after the hold sections Hd1 to Hdp end, a pulse width of the gate-on voltage applied to each of the gate lines G1 to Gn can be controlled to prevent the luminance difference from being visible. A charging time of the data voltage Vd can be controlled by controlling a gate-on pulse width, and accordingly the luminance of the pixel PX can be controlled. An example of such a method is described in more detail in association with FIG. 9.

Figure 9:
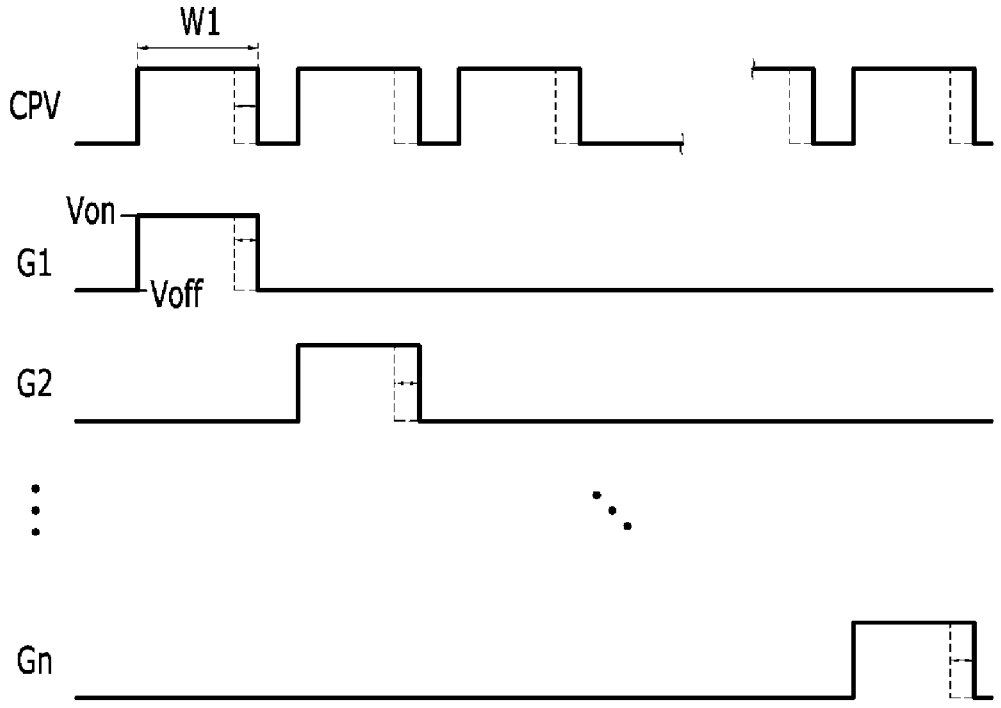
FIG. 9 is a waveform diagram associated with a driving signal of a display device, according to exemplary embodiments.

FIG. 9 is a waveform diagram associated with a driving signal of a display device, according to exemplary embodiments.

With reference to FIG. 9, the gate control signal CONT1 received by the gate driver 400 may further include a gate clock signal CPV to facilitate control of an output time of a gate-on pulse. A period of a pulse of the gate clock signal CPV may be a one horizontal period 1H. To this end, the gate driver 400 may sequentially transmit the gate-on voltage Von corresponding to a high section of the gate clock signal CPV to the gate lines G1 to Gn.

Accordingly, the width of the pulse of the gate-on voltage Von can be controlled in every frame of the first refresh section Rf1 by considering the discharged voltage of the pixel PX in the hold sections Hd1 to Hdp before the refresh sections Rf1 to Rfk. In his manner, the change in the luminance may be made invisible when the refresh sections Rf1 to Rfk start. To this end, a width W1 of the high section of the gate clock signal CPV or a duty ratio can be controlled in every frame of the first refresh section Rf1.

More specifically, the duty ratio of the gate clock signal CPV during the first frame of respective refresh sections Rf1 to Rfk may be smaller than the duty ratio of the gate clock signal CPV in the motion picture section MV. Further, the duty ratio of the gate clock signal CPV may be gradually increased as every frame of each of the refresh sections Rf1 to Rfk passes. To this end, the duty ratio of the gate clock signal CPV of the last frame may be close to or substantially the same as the duty ratio of the gate clock signal CPV in the gate scanning GS of respective hold sections Hd1 to Hdp or the duty ratio of the gate clock signal CPV in the motion picture section MV.

According to exemplary embodiments, the pulse width or the duty ratio of the gate clock signal CPV may vary according to the frames of all sections of the still image section ST.

According to exemplary embodiments, in order to prevent the flicker due to the luminance difference in switching between the hold sections Hd1 to Hdp and the refresh sections Rf1 to Rfk, one or more methods among an absolute value controlling of the data voltage Vd and a duty ratio controlling of the gate clock signal CPV may be used in the above described refresh sections Rf1 to Rfk.

Figure 10:
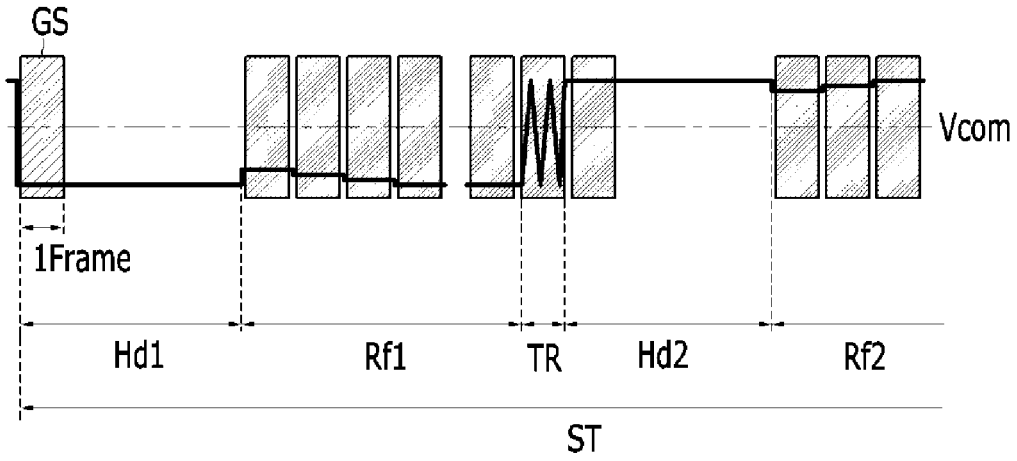
FIG. 10 is a waveform diagram associated with a driving signal of a display device, according to exemplary embodiments.
Figure 11:
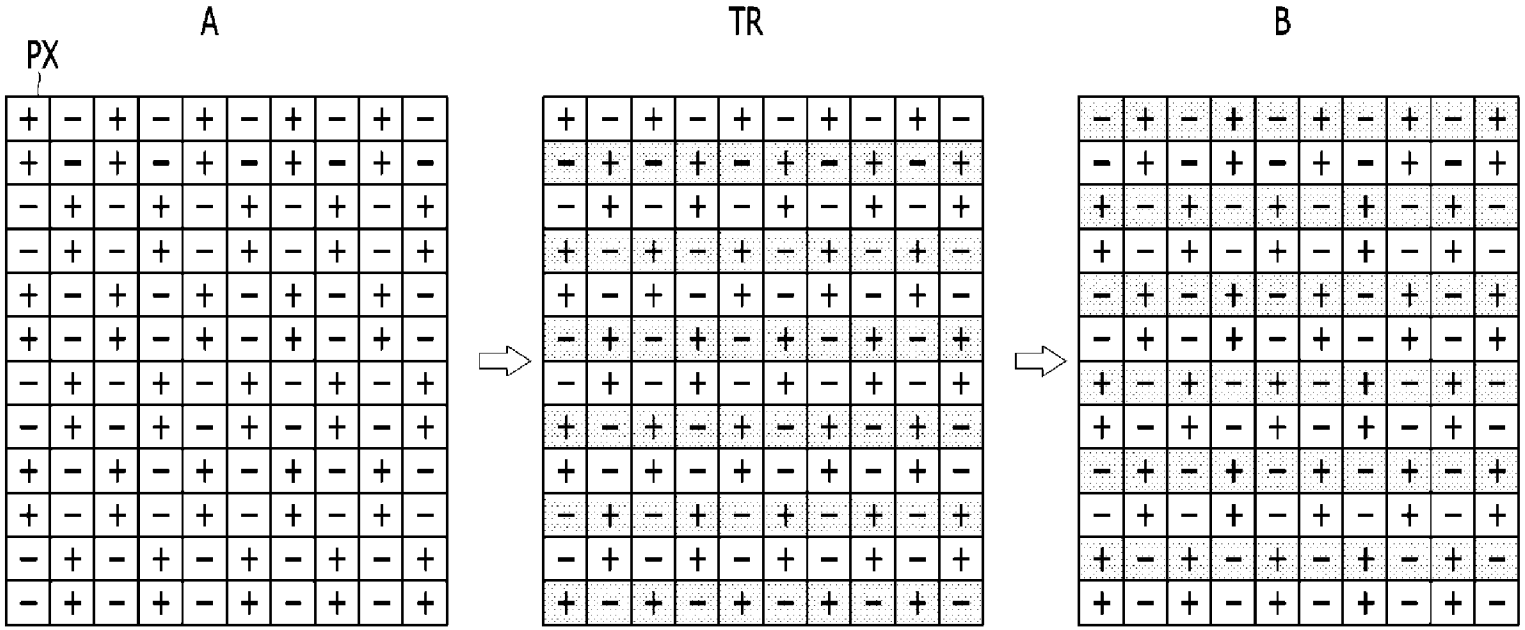
FIG. 11 is a diagram of polarity inversion in association with a display device, according to exemplary embodiments.

FIG. 10 is a waveform diagram associated with a driving signal of a display device, according to exemplary embodiments. FIG. 11 is a diagram of polarity inversion in association with a display device, according to exemplary embodiments.

With reference to FIG. 10, a method to drive the display device is similar to the previously described method, however, one or more transition frames TRs may be further positioned between two frames in which the polarity of the data voltage Vd is changed. The transition frame TR refers to a frame in which only the polarity of the data voltage Vd charged to some of the entire pixel PX is changed.

For example, and with reference to FIG. 11, when a frame before the frame in which the polarity of the data voltage Vd is changed from frame A and a frame in which the polarity of the data voltage Vd applied to the entire pixel PX is changed to frame B, the transition frame TR in which only the polarities of some of the entire pixel PX are changed may be located between the two frames A and B. FIG. 11 demonstrates when polarities of the data voltages Vd of the pixels PX in an even numbered pixel row are reversed in the transition frame TR. Since the polarities of the data voltages Vd of the pixels PX in an odd numbered pixel row are reversed in the frame B, all polarities of the charging voltages of the entire pixel PX are changed from the frame A.

Alternatively, two or more transition frames TRs may be located between the two frames A and B. When the number of transition frames TRs is n, a frame in which 1/(n+1) polarities of the data voltage Vd of the entire pixel PX are reversed is sequentially positioned from a first transition frame.

The transition frame TR may be inserted between a start of the hold sections Hd1 to Hdp and an end of the refresh sections Rf1 to Rfk, as shown in FIG. 10. As shown in FIG. 4, 5 or 7, one or more transition frames TRs may be inserted between two frames between which the polarity of the data voltage Vd is reversed in a case where the polarity of the data voltage Vd is reversed in the refresh sections Rf1 to Rfk.

As described, when the transition frame TR is inserted between the two frames between which a frame inversion is performed, a luminance change in the polarity inversion can be minimized.

FIG. 12 is table of measured flicker levels associated with a display device, according to exemplary embodiments.

Referring to FIG. 12, as the first frequency corresponding to a driving frequency when the motion picture is displayed is reduced to 60 Hz, 30 Hz, and 20 Hz, a flicker figure (measured in decibels dBs) is gradually increased and, as such, a flicker phenomenon is readily visible. Accordingly, when the second frequency corresponding to a driving frequency when the still image is displayed is in, for example, a 30 Hz level, the flicker is readily visible. However, according to exemplary embodiments, when the still image is displayed, almost the same flicker figure can be identified even though the second frequency is low, such as 20 Hz to 30 Hz or 15 Hz to 20 Hz in comparison with a case where the driving frequency is 60 Hz. That is, although the still image is displayed with a low driving frequency, a display quality can be improved by significantly reducing the flicker.

While certain exemplary embodiments and implementations have been described herein, other embodiments and modifications will be apparent from this description. Accordingly, the invention is not limited to such embodiments, but rather to the broader scope of the presented claims and various obvious modifications and equivalent arrangements.

What is claimed is:

1. A method to drive a display device, the method comprising:

transmitting at least one data voltage to one or more of a plurality of data lines;

scanning one or more of a plurality of gate lines to enable transmission of a gate signal in association with a first frame of a first hold section of a first still image section associated with display of a still image;

scanning one or more of the plurality of gate lines to enable transmission of the gate signal every frame of a first refresh section;

determining a number of frames associated with the first still image section;

summing polarities of the at least one data voltage;

generating, based on a result of the summing, a data modification signal comprising polarity information of a next image signal;

processing the next image signal based on the data modification signal to generate image data; and converting the image data to the at least one data voltage, wherein the first still image section comprises the first refresh section.

2. The method of claim 1, further comprising:

determining, based on the data modification signal, a polarity of the at least one data voltage corresponding to a first frame associated with a second still image section.

3. The method of claim 2, further comprising:

scanning one or more of the plurality of gate lines to enable transmission of the gate signal in association with a first frame of at least one third hold section, the second still image section comprising the at least one third hold section; and determining, based on the data modification signal, a number of frames associated with the at least one third hold section.

4. The method of claim 1, further comprising:

scanning one or more of the plurality of gate lines to enable transmission of the gate signal in association with at least one transition frame positioned between the first refresh section and a second hold section, the first still image section further comprising the at least one transition frame and the second hold section after the first refresh section, wherein, in the at least one transition frame, polarities of some data voltages charged to some pixels of a plurality of pixels are reversed with respect to a previous frame, and wherein, in the second hold section, polarities of other data voltages charged to other pixels of the plurality of pixels are reversed with respect to the previous frame.

5. A display device, comprising:

a plurality of gate lines configured to transmit a gate signal;

a plurality of data lines configured to transmit a data voltage;

a plurality of pixels connected to the plurality of gate lines and the plurality of data lines;

a gate driver configured to transmit the gate signal to at least one of the plurality of gate lines;

a data driver configured to transmit the data voltage to at least one of the plurality of data lines; and a signal controller configured to control the gate driver and the data driver, wherein the plurality of pixels are configured to display a still image in association with a still image section comprising a first hold section and a first refresh section, and wherein the gate driver is further configured to:

scan at least some of the plurality of gate lines to enable transmission of the gate signal to at least some of the plurality of pixels in association with a first frame of the first hold section; and scan at least some of the plurality of gate lines to enable transmission of the gate signal every frame of the first refresh section, and wherein the signal controller is further configured to:

determine a number of frames associated with the still image section, sum polarities of the at least one data voltage, generate, based on a result of the summing, a data modification signal comprising polarity information of a next image signal, process the next image signal based on the data modification signal to generate image data, and convert the image data to the at least one data voltage.

6. The display device of claim 5, wherein:

the still image section further comprises a second hold section after the first refresh section;

the gate driver is further configured to scan at least some of the plurality of gate lines to enable transmission of the gate signal to at least some of the plurality of pixels in association with a first frame of the second hold section; and a polarity of the data voltage associated with the first hold section is opposite to a polarity of the data voltage associated with the second hold section.

7. The display device of claim 6, wherein an absolute value of the data voltage between at least some neighboring frames associated with the first refresh section is different.

8. The display device of claim 7, wherein an absolute value of the data voltage associated with the first frame of the second hold section is different from an absolute value of the data voltage associated with the first hold section.

9. The display device of claim 8, wherein a polarity of the data voltage associated with the first refresh section is reversed every frame.

10. The display device of claim 9, wherein:

the still image section further comprises at least one transition frame, the gate driver being configured to scan at least some of the plurality of gate lines in association with the at least one transition frame, the at least one transition frame being positioned between the first refresh section and the second hold section;

wherein, in the at least one transition frame, polarities of some data voltages charged to some pixels of the plurality of pixels are reversed with respect to a previous frame, and wherein, in the second hold section, polarities of other data voltages charged to other pixels of the plurality of pixels are reversed with respect to the previous frame.

* * * * *